US007681370B2

(12) United States Patent
Waters et al.

(10) Patent No.: US 7,681,370 B2
(45) Date of Patent: Mar. 23, 2010

(54) SUSPENSION SYSTEMS

(75) Inventors: James R. Waters, Lancaster, PA (US); Eric Krantz-Lilienthal, Lancaster, PA (US); Joseph R. Woelfling, Palmyra, PA (US)

(73) Assignee: AWI Licensing Company, Wilmington, DE (US)

( * ) Notice: Subject to any disclaimer, the term of this patent is extended or adjusted under 35 U.S.C. 154(b) by 41 days.

(21) Appl. No.: 11/489,857

(22) Filed: Jul. 20, 2006

(65) Prior Publication Data

US 2007/0033902 A1 Feb. 15, 2007

Related U.S. Application Data

(60) Provisional application No. 60/700,929, filed on Jul. 20, 2005.

(51) Int. Cl.
*E04B 9/18* (2006.01)

(52) U.S. Cl. ..... 52/506.08; 52/506.07; 52/506.09; 52/801.1

(58) Field of Classification Search ..... 52/506.07, 52/506.08, 506.09, 801.1, 801.11, 510, 309.7, 52/39, 22; 248/342, 343, 344
See application file for complete search history.

(56) References Cited

U.S. PATENT DOCUMENTS 3,511,463 A * 5/1970 Thomas et al. ..... 248/343
3,581,453 A * 6/1971 Jones et al. ..... 52/506.1
3,608,264 A 9/1971 Jones et al.
3,998,014 A * 12/1976 Bartels et al. ..... 52/100
4,034,531 A * 7/1977 Balinski ..... 52/506.07
4,517,236 A * 5/1985 Meeker et al. ..... 428/192
4,642,951 A * 2/1987 Mortimer ..... 52/145
4,786,543 A * 11/1988 Ferm ..... 428/138
4,856,246 A * 8/1989 Shimasaki ..... 52/386
5,417,050 A * 5/1995 Cosentino ..... 52/506.08
5,428,930 A * 7/1995 Bagley et al. ..... 52/506.07
5,456,383 A * 10/1995 Polvere et al. ..... 221/282
5,845,447 A * 12/1998 Bodine et al. ..... 52/506.09
6,117,514 A * 9/2000 Herrmann ..... 428/81
6,164,029 A * 12/2000 Lee ..... 52/386
6,374,564 B1 * 4/2002 Fletterick et al. ..... 52/506.07
6,499,262 B1 12/2002 Pinchot et al.
6,723,419 B2 * 4/2004 Rogers ..... 428/158
6,929,091 B2 * 8/2005 Bertagni et al. ..... 181/150
6,964,137 B2 * 11/2005 Frascari ..... 52/235
2003/0205016 A1 * 11/2003 Gulbrandsen et al. .... 52/506.06
2004/0068953 A1 4/2004 Sauer
2004/0129492 A1 * 7/2004 Bertagni et al. ..... 181/150
2005/0011150 A1 * 1/2005 Stackenwalt et al. ..... 52/311.1
2005/0206569 A1 * 9/2005 Arndt et al. ..... 343/700 MS

* cited by examiner

*Primary Examiner*—Brian E Glessner
*Assistant Examiner*—James J Buckle, Jr.

(57) ABSTRACT

An easily installed, aesthetically pleasing island ceiling system is provided. The system includes a soft fiber panel having a top surface, a bottom surface and an edge extending therebetween. The top surface includes a routed channel which does not extend to the edge of the panel. The system also includes suspension hardware which supports the panel in both the longitudinal and cross axes when suspended from an overhead ceiling or wall.

7 Claims, 10 Drawing Sheets

SUSPENSION SYSTEMS

CROSS REFERENCE TO RELATED APPLICATION

This application claims the benefit under 35 U.S.C. §119 (e) of U.S. provisional application Ser. No. 60/700,929, filed Jul. 20, 2005.

BACKGROUND OF THE INVENTION

The present invention is directed to a suspension system for a ceiling, and more particularly to a suspended floating ceiling system.

Conventional suspended ceiling systems found in offices, retail stores and similar commercial settings typically include suspended grids which support acoustically performing soft fiber panels. These systems typically extend the entire length of the room in an uninterrupted manner, i.e. are continuous, and create a uniform appearance. While such continuous suspended systems provide a pleasant and acoustically absorbent space, designers, architects and building owners often object to the use of these systems for several reasons, including the cost of materials to accommodate the entire span. As a result, more and more interior building spaces have open ceiling, or open-plenum, designs in which at least a substantial portion of the hard ceiling, HVAC duct work, wiring and the like are exposed. The open-plenum design, however, tends to leave the space unstructured and, therefore, less useful and less aesthetically pleasing.

In the open-plenum interior building environment, ceiling systems which utilize floating ceiling panels, herein also referred to as suspended ceiling islands, are in increasing demand as these ceiling islands provide architects and designers with the ability to create unique structures with dramatic visual effects not available with conventional grid suspension ceilings. In addition, island ceilings differentiate the space in a room and provide functionality such as sound absorption and light reflectance.

It is desirable from an aesthetic standpoint for the island ceiling to have no visible suspension hardware and to have clean finished edges free of any exposed, unsightly edge detail or fastening means. One known way to minimize the visibility of the hardware is to move the suspension hardware from the edges of the ceiling to the back of the panel. In some instances, the hardware is embedded, at least partially, in the panel thereby forming a panel module. Known fabrication methods for embedding suspension hardware into the panel include: casting the panel around the suspension hardware; laminating two or more panels together and embedding the hardware in between; and routing the panel and inserting the hardware. These known techniques have several shortcomings.

For example, the casting and laminating techniques are preferably implemented during manufacturing. Panels with the suspension hardware embedded therein, i.e. as modules, are susceptible to damage during transport. At the same time, if these fabrication methods are implemented outside of the manufacturing process, the panel modules are highly susceptible to irregularities. It is important to note that casting and laminating, whether completed in the manufacturing process or in the field, are quite costly techniques.

Another known less expensive solution for embedding the suspension hardware is back-routing the panel. One such product is the Cloud Panel system available from Tectum, Inc. Tectum's Cloud Panel system is composed of rigid wood fiber acoustically absorbent material. As shown in prior art FIG. 1 and, these prior art panels 1 have routed channels 2 of inverted-T configuration, positioned in parallel relation to one another. The panels are supported by conventional inverted-T grid and hanger wire. As shown in FIG. 1, a conventional grid member 5A of inverted-T configuration can be inserted into the channel 2 through one of the vertical edges 3 and is slid the entire length of the panel 1 until the grid member 5A is no longer positioned above the edge 3 of the panel 1 as shown in FIG. 2.

In Tectum's Cloud Panel system, the inverted-T channels 2 span the entire length of the panel 1 and extend through the vertical edges 3 and the back surface 4 of the panel 2. It is widely known in the art that the structural integrity of the panel is compromised when the back-routing extends through the edge of the panel, and in particular, when the back-routing is a one-hundred percent through-cut. This is even more of a concern in routing soft fiber panels.

Additionally, panels supported by grid members extending in parallel relation to one another, for example grid members 5A and 5B, are susceptible to sag. The panel is particularly susceptible to sag between grid members if the grid members are spaced from one another at too great a distance relative the weight of the panel. Thus, too prevent sag, the grid members must be spaced within relatively small distances from one another, and, thus, more through-cut routing, i.e. a cut which penetrates an edge and is continuous through the board until it penetrates out through the edge at some point along the circumference of the edge of the panel. The more through-cut routing imparted to the panel, the less structurally stable the panel becomes.

It should further be noted that the Tectum Cloud Panel system requires an additional finishing step to eliminate the visibility of the routing detail 2 at the edge 3 of the panel 1, which ultimately increases the cost of the panel.

The present invention is directed to an improved suspended island ceiling system which limits the visibility of the suspension hardware, substantially preserves the structural integrity of the panel, and, at the same time, provides finished edges without the need for a finishing step.

SUMMARY OF THE INVENTION

The ceiling system of the invention includes a fiber panel having a top surface, a bottom surface and an edge extending therebetween. The top surface includes a routed channel which does not extend to the edge, or penetrate, the edge of the panel. The system also includes suspension hardware which supports the panel in both the longitudinal and cross axes when suspended from an overhead ceiling or wall.

One advantage of the current invention is provided by the in-board channel feature. For purposes of this description, the term in-board channel is defined as a channel that does not extend to the edges of the panel. More specifically, the in-board channel substantially preserves the integrity of the panel as there are no through-cut, and, at the same time, provides freedom of the edges. In other words, the edge configuration is not dictated by the support structure. Also, no additional edge detail, such as a trim element, is required to finish the edge of the panel.

Another advantage of the system of the invention is that it allows modification of known attachment methods using conventional ceiling components. The use of these conventional components and modified known attachment methods provides ease with respect to installation, thereby reducing the chance of irregularities upon installation. Also, the system is capable of providing a visual not currently available in the marketplace with the same components in their traditional application.

A further advantage is that the assembled hardware provides support along both the longitudinal and cross direction axes, which substantially inhibits sag.

Still another advantage is that the system can be transported to the installation site as a kit of parts which dramatically reduces the susceptibility of the parts to damage during transport.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
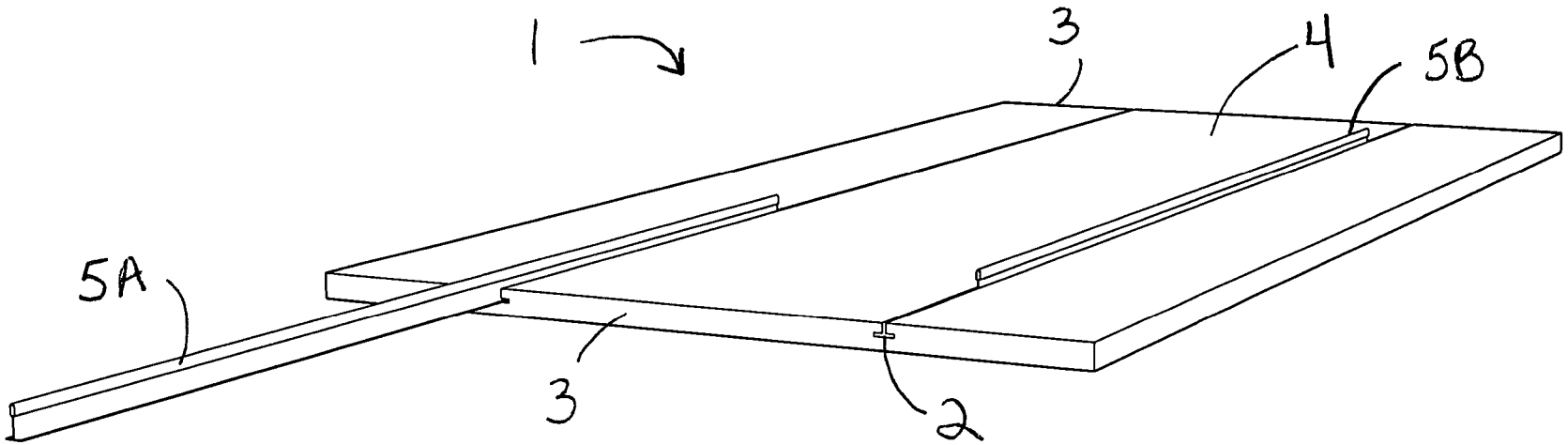
FIGURE 1 PRIOR ART
FIG. 1 is a partially exploded perspective view illustrating a conventional routing channel in a ceiling panel and the method of installation.
Figure 2:
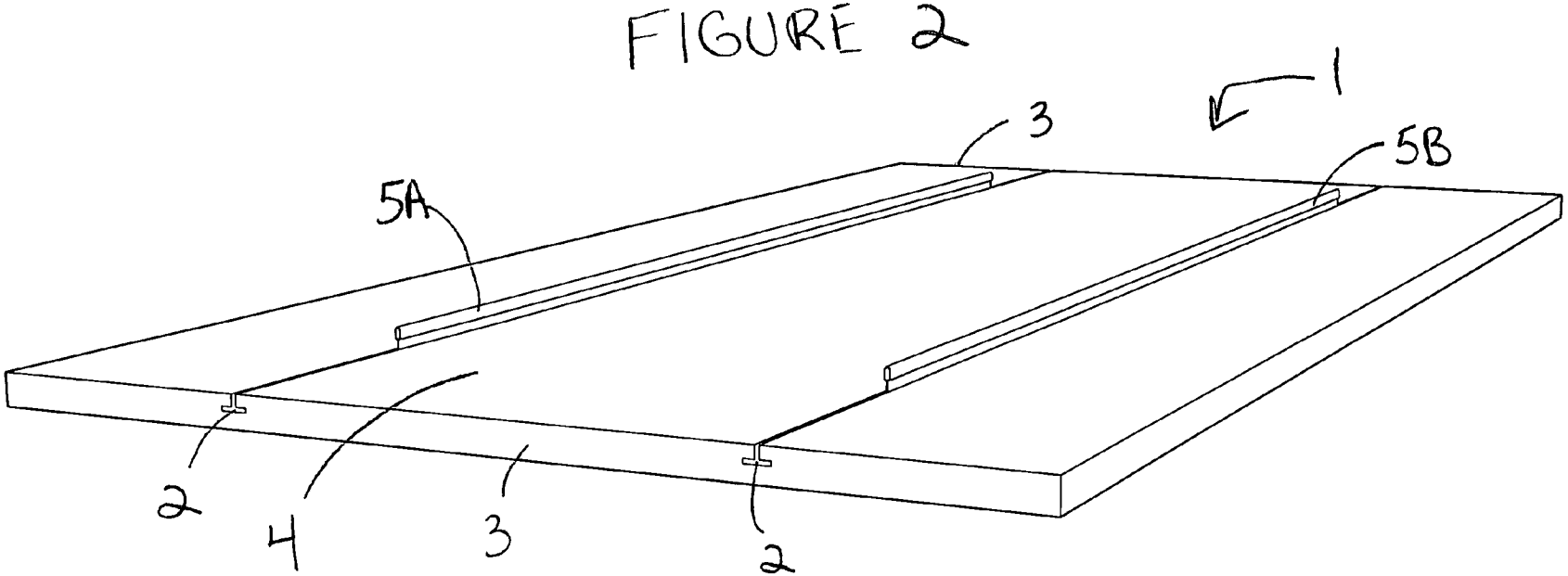
FIGURE 2 PRIOR ART
FIG. 2 is a perspective view illustrating a conventional routing channel in a ceiling panel.
Figure 3:
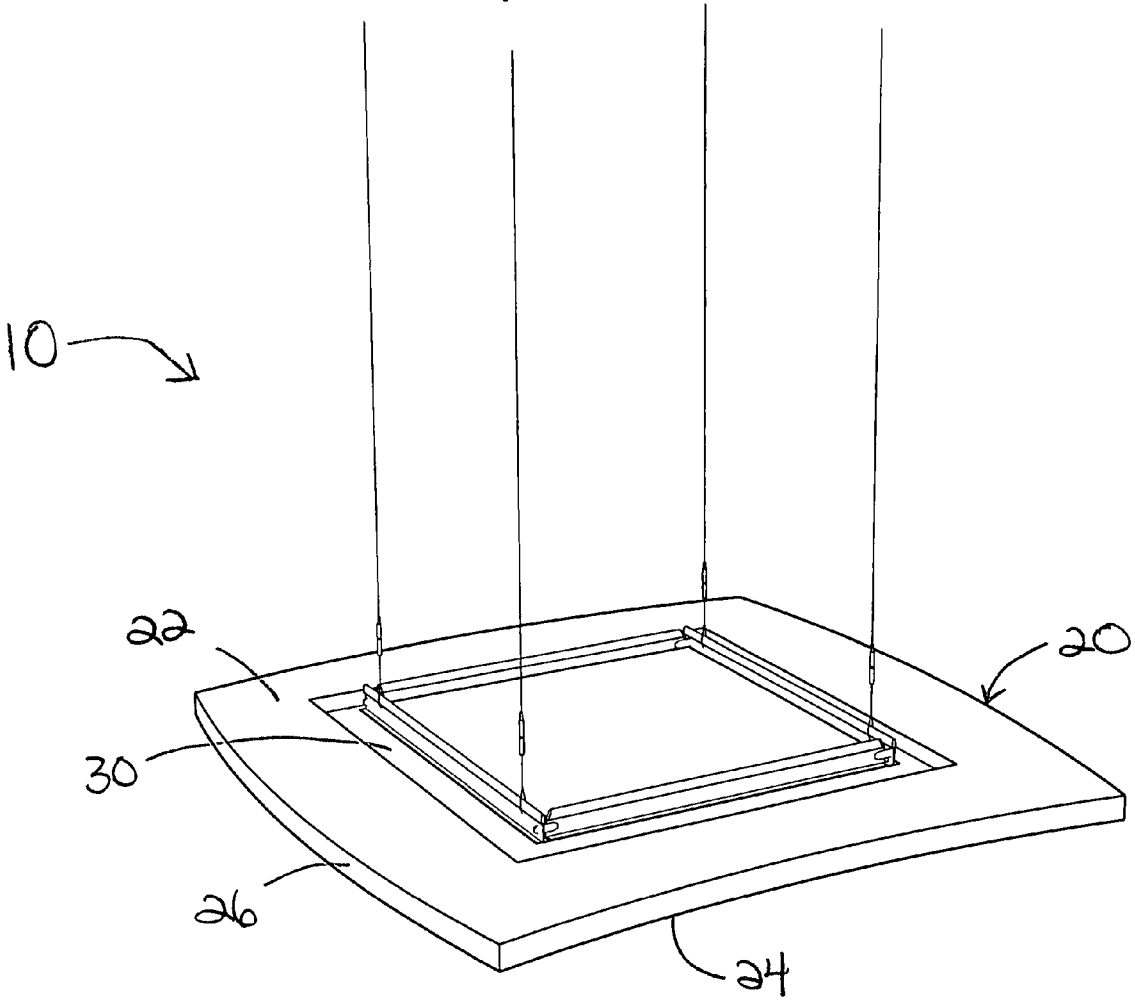
FIG. 3 is a perspective view of a first example embodiment of the present invention.
Figure 4:
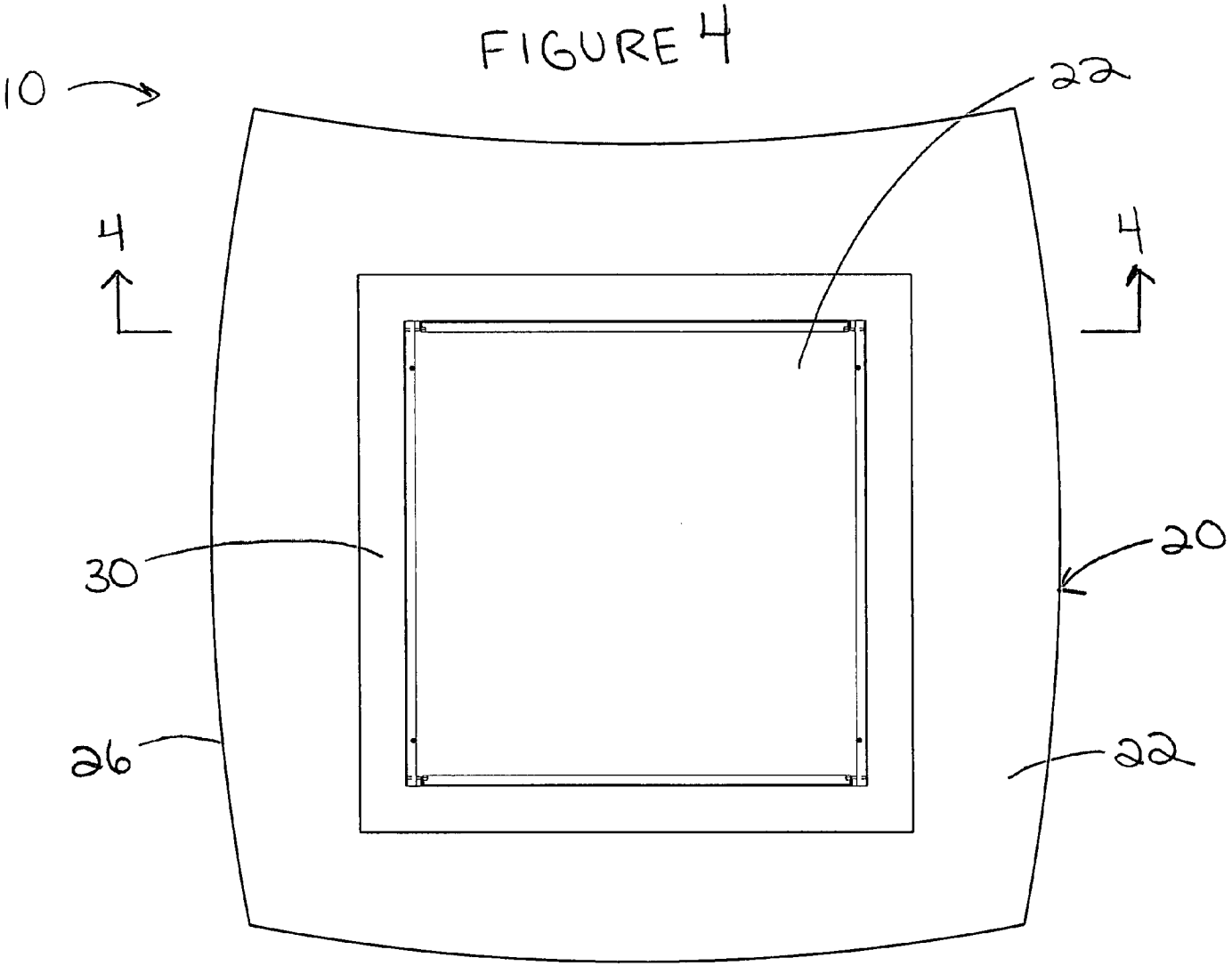
FIG. 4 is a top plan view of FIG. 3.

FIGS. 3 and 4 illustrate the general structural arrangement of an example embodiment of the island ceiling system in accordance with this invention. The ceiling system 10 includes a panel 20, and preferably a fibrous acoustical panel, having a top surface 22, an opposed bottom surface 24 and an edge 26 extending therebetween. The panel 20 includes an in-board routed channel 30 which forms a closed back-route detailing. The channel 30 extends from the top surface 22 of the panel in a direction toward the bottom surface 24.

Figure 5:
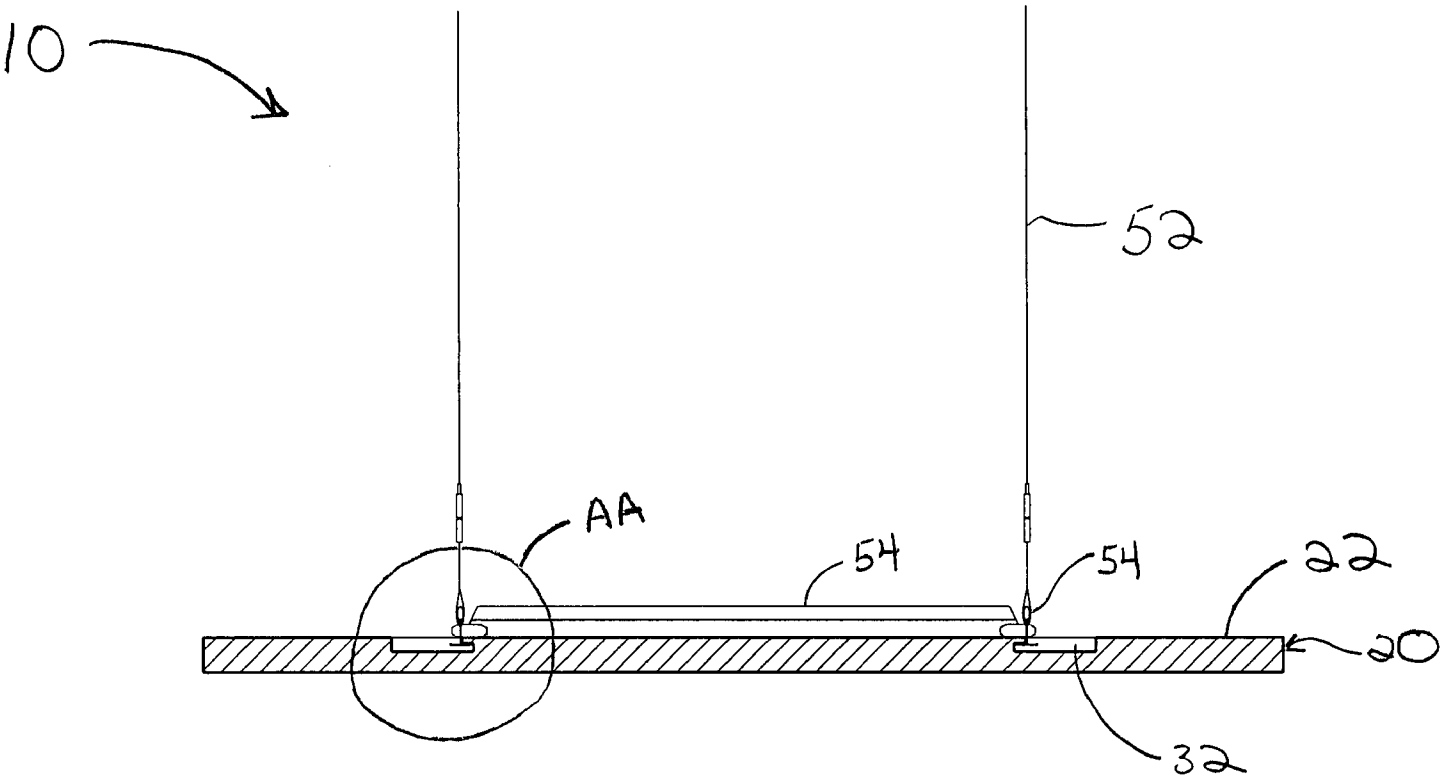
FIG. 5 is a cross-sectional view taken along line 4-4 in FIG. 4.
Figure 6:
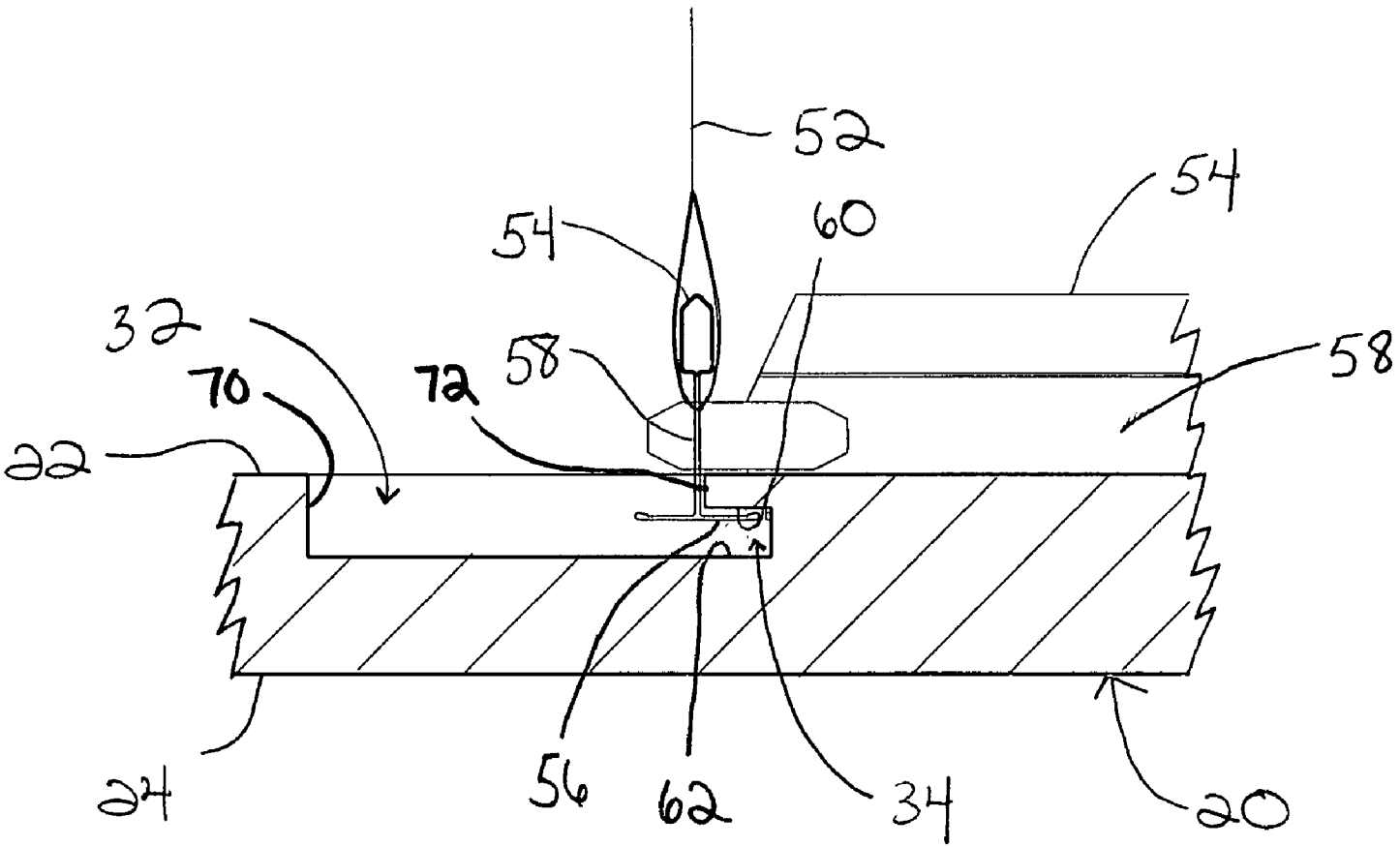
FIG. 6 is an enlarged illustration of circled portion AA in FIG. 5.

As best shown in FIGS. 5 and 6, a first channel recess portion 32 of the channel extends from the top surface 22 in a direction toward the bottom surface 24. A second kerfed portion 34 extends from the first recess portion 32. In this illustration, the second kerfed portion 34 extends from the first recess portion 32 in a direction substantially parallel to top surface 22 and forms a substantially L-shaped channel in combination with the first recess portion 32 for insertion of suspension hardware which will be described in greater detail below. It should be noted that the downwardly extending recess portion 32 only needs to be wide enough to provide clearance for insertion of the hardware into the channel and ultimately into the second kerfed portion 34. It should be noted that although the second kerfed portion 34 shown in FIGS. 3-7 extends from the first channel recess portion 32 in the direction of the interior of the panel 20, the second kerf portion 34 could also extend from the first channel recess portion 32 in the direction of the exterior of the panel 20.

Figure 7:
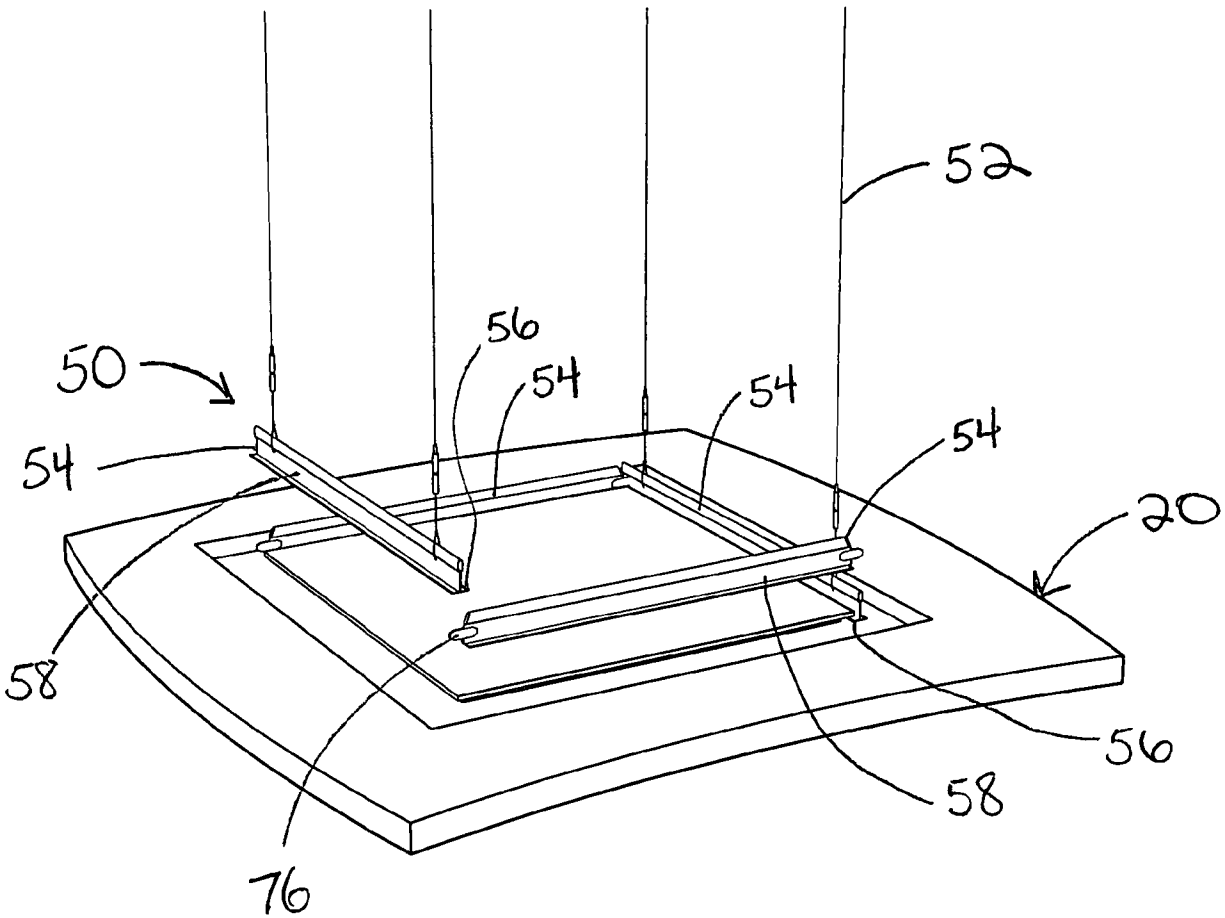
FIG. 7 is a partially exploded perspective view of FIG. 3.

As best shown in FIGS. 5-7, the system also includes suspension hardware 50 which supports the panel 20 when suspended from an overhead ceiling or wall by suspension cables 52. The suspension hardware 50 includes one or more suspension bars 54, each having a substantially vertically extending web portion 58 and at least one flange portion 56 extending from the edge of the web portion 58. Preferably, the suspension bars 54 are mechanically attached to one another to form an inter-locking continuous suspension bar. For example, the suspension bars 54 can be attached in the manner main beams are conventionally attached to cross beams in a conventional wall-to-wall suspension system. Various types of suspension bars 54, such as the types typically used in full suspended wall-to-wall ceiling systems, may be used to form the assembled suspension hardware 50. For purposes of illustration, the suspension bars 54 shown throughout the drawings are conventional inverted-T grid members.

Although the drawings illustrate the use of four separate suspension bars 54 and, and thus, four locking connection points, it should be noted that as little as one suspension bar could be used. For example, a single suspension bar 54 of sufficient length could be bent upon itself to conform substantially to the shape of channel 30, regardless of the shape of channel 30. The single suspension bar would then be connected at its ends to form a continuous inter-locked element. The key is for the suspension bar, or series of bars, to extend continuously around the circumference of the channel.

When assembled to the panel, the suspension bars 54 are capable of providing rigid support for the soft fiber panel 20 in both the longitudinal and cross directional axes of the soft fiber panel. A key feature is that the flange portion 56 of each suspension bar is positioned in the between the top and bottom walls, 60 and 62 respectively, of the second kerfed portion 34. To achieve the largest amount of rigidity, and least amount of play of the suspension hardware in the channel of the panel, the vertical portion 58 of each suspension bar 54 is in contact with the side walls, 70 and 72 respectively, of the first recess portion 32 of the channel. When the panel is suspended in a substantially horizontal position, e.g. by suspension cables 52, the top wall 60 of the second channel portion 34 rests on, and is supported by, flange portion 56.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

A first example modification would be to have the second kerfed portion 34 extend from the first channel recess portion 32 in the direction of the exterior of the panel 20, rather than in the direction of the interior of the panel 20. This would require suspension members 54 of slightly greater length.

Figure 8:
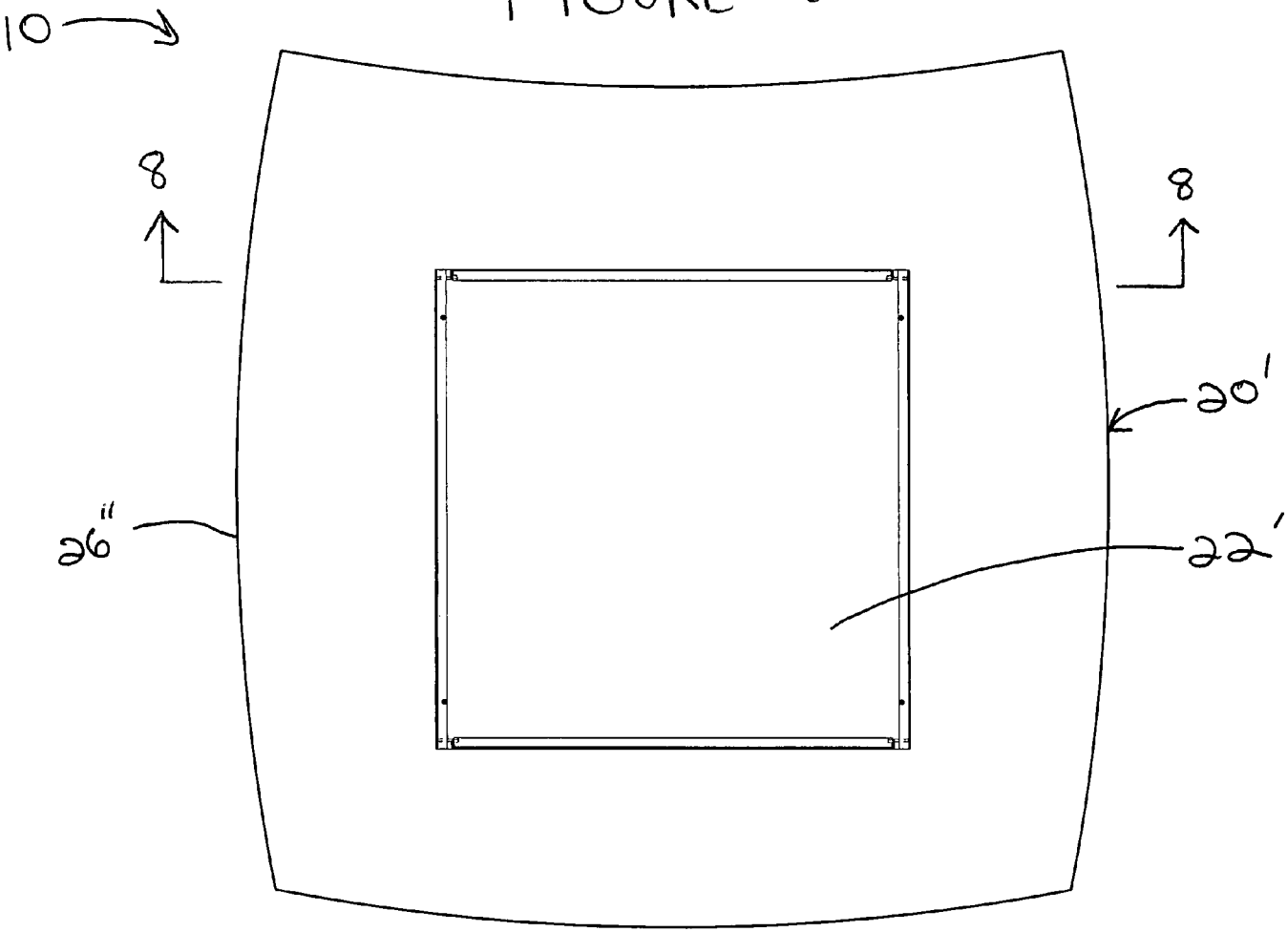
FIG. 8 is a top plan view of an alternative example embodiment of the invention.
Figure 9:
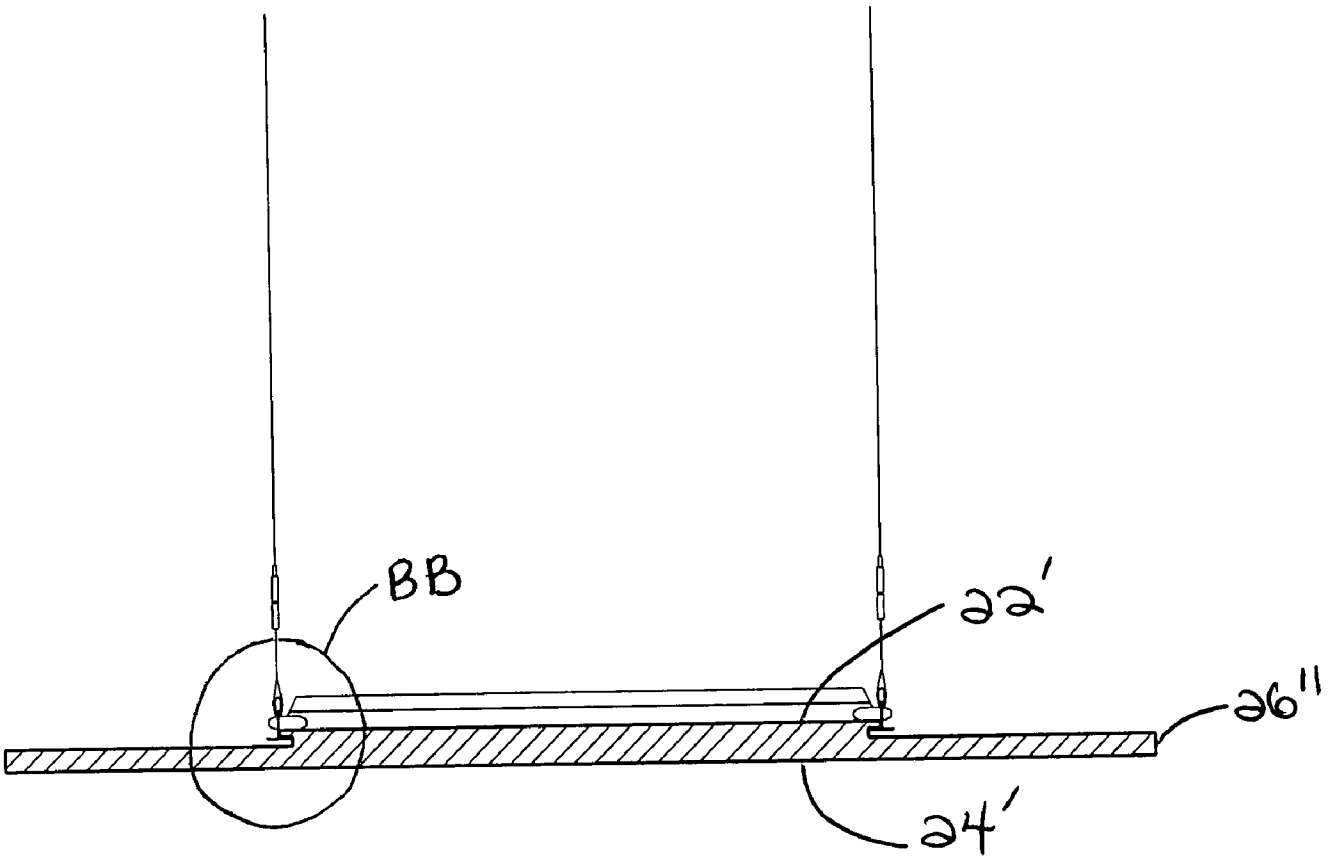
FIG. 9 is a cross-sectional view taken along line 8-8 in FIG. 8.
Figure 10:
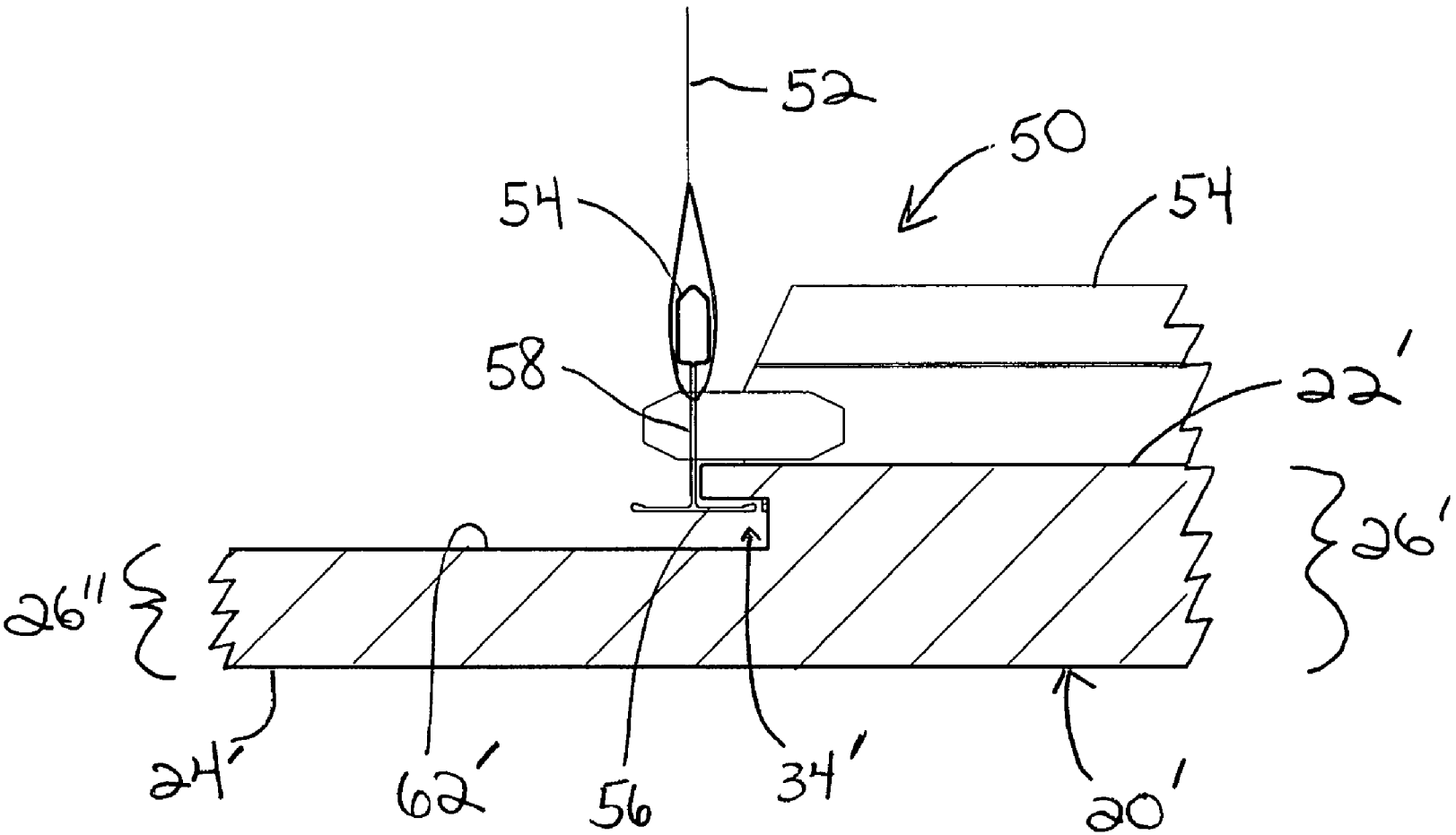
FIG. 10 is an enlarged illustration of circled portion BB in FIG. 9.

FIGS. 8-10 illustrate a second example modification. In this example embodiment, the portion of the panel between the channel 30 (FIGS. 3-7) and the edge of the panel 26 (FIGS. 3-7) has been removed. In this example configuration of the system 10' the entire length of edge 26' of the panel 20' can still be defined as the distance between the top surface 22' and the bottom surface 24'. However, when the panel 20' is suspended substantially horizontally and viewed from below, the only portion of the edge that will be visible is the portion of the edge defined by the distance between the bottom wall 62' of the kerfed portion 34' and the bottom surface 24' of the panel 20'. The edge is designated 26" in FIGS. 8-10. The remaining portion of the edge containing the edge detailing, i.e. the detailing of the kerfed portion 34' is essentially hidden in the back of the panel. The suspension hardware 50 is attached to the panel 20' in the same manner set forth above.

We claim:

1. A panel for use in a suspended ceiling system, the panel comprising a soft fiber substrate having a top surface, a bottom surface and a circumferential edge surface interposed between the top and bottom surfaces; a continuous, multidirectional in-board channel being routed in the top surface of the substrate; wherein the continuous, multidirectional in-board channel does not extend to the circumferential edge surface of the panel; the panel further comprising suspension bars which are positioned in the in-board channel, wherein all suspension points are in-board of the circumferential edge of the substrate; wherein the in-board channel includes a recess portion and a kerfed portion, the recessed portion extends from the top surface of the panel and the kerfed portion of the channel extends from the recessed portion.

2. The panel of claim 1, wherein the recessed portion extends in a direction toward the bottom surface of the panel.

3. The panel of claim 2, wherein the kerfed portion extends in a direction substantially perpendicular to the recessed portion.

4. The panel of claim 1, wherein each suspension bar is mechanically and directly locked to another suspension bar.

5. The panel of claim 1, wherein the suspension bars form an interlocked continuous orthogonal anchoring element.

6. The panel of claim 1, wherein the suspension bars provide support to the substrate in both the longitudinal and cross axes.

7. The panel of claim 1, wherein the continuous, multidirectional in-board channel is routed orthogonally in the top surface of the substrate.

* * * * *